US006918974B2

(12) United States Patent
Woodfield

(10) Patent No.: US 6,918,974 B2
(45) Date of Patent: Jul. 19, 2005

(54) PROCESSING OF ALPHA-BETA TITANIUM ALLOY WORKPIECES FOR GOOD ULTRASONIC INSPECTABILITY

(75) Inventor: Andrew Philip Woodfield, Madeira, OH (US)

(73) Assignee: General Electric Company, Schenectady, NY (US)

( * ) Notice: Subject to any disclaimer, the term of this patent is extended or adjusted under 35 U.S.C. 154(b) by 235 days.

(21) Appl. No.: 10/228,701

(22) Filed: Aug. 26, 2002

(65) Prior Publication Data

US 2004/0035509 A1 Feb. 26, 2004

(51) Int. Cl.[7] ..... C22C 1/18
(52) U.S. Cl. ..... 148/671; 148/670
(58) Field of Search ..... 148/669, 670, 148/671

(56) References Cited

U.S. PATENT DOCUMENTS 6,190,473 B1 * 2/2001 Martin ..... 148/671
6,284,070 B1 * 9/2001 Gorman et al. ..... 148/668
6,332,935 B1 * 12/2001 Gorman et al. ..... 148/508
6,387,197 B1 * 5/2002 Bewlay et al. ..... 148/669

OTHER PUBLICATIONS

M. Brun et al., "Demands to Bimodal Structure with Optimal Combination of Mechanical Properties and Regimes for its Development," *Titanium 95, Science and Technology*, 1995, pp. 2421–2429.

* cited by examiner

*Primary Examiner*—John P. Sheehan
(74) *Attorney, Agent, or Firm*—McNees Wallace & Nurick LLC

(57) ABSTRACT

An alpha-beta titanium alloy workpiece, preferably furnished in the form of a cast ingot, is processed by mechanically working in the beta phase field and in the alpha-beta phase field, and thereafter quenching from the beta phase field. The workpiece is thereafter mechanically worked at a first alpha-beta phase field temperature in the alpha-beta phase field and quenched from the first alpha-beta phase field temperature. The workpiece is thereafter mechanically worked at a second alpha-beta phase field temperature in the alpha-beta phase field, wherein the second alpha-beta phase field temperature is lower than the first alpha-beta phase field temperature, and optionally quenched from the second alpha-beta phase field temperature. The resulting microstructure is a distribution of globularized coarse alpha-phase particles and globularized fine alpha-phase particles in fine transformed beta grains.

19 Claims, 3 Drawing Sheets

PROCESSING OF ALPHA-BETA TITANIUM ALLOY WORKPIECES FOR GOOD ULTRASONIC INSPECTABILITY

This invention relates to the thermomechanical processing of alpha-beta titanium alloy workpieces such as cast ingots, to form an article having good ultrasonic inspectability.

BACKGROUND OF THE INVENTION

Several critical components of commercial and military gas turbine engines are manufactured from titanium-alloy billets. The billets are prepared by melting the titanium alloy of the appropriate composition, casting the titanium alloy as an ingot, and converting the ingot to the billet form. After appropriate mechanical working of the billet to the required thickness and diameter, the component is machined from the billet.

The billet must be readily inspectable by ultrasonic techniques at various stages of the mechanical working process. The ultrasonic inspection detects defects such as cracks, tears, and chemical inhomogeneities that may be present in the workpiece. Such defects, if undetected, are present in the final article and may lead to its premature failure if the defect is sufficiently large. It is absolutely critical that defects of small size be detected during the mechanical working processing, preferably as early in the processing as possible, so that the defect-containing workpieces may be removed from the processing without incurring additional costs or repaired, if that is possible.

Examples of such components include fan disks and compressor disks. These components support respective fan and compressor blades and rotate at high speeds about their shafts during service of the gas turbine engine. If such a disk fails due to the presence of an undetected defect, the gas turbine engine may be torn apart, with catastrophic results for the aircraft.

Alpha-beta titanium alloys are of most interest in fabricating such gas turbine components, because they have desirable mechanical properties that may be tailored by appropriate thermal and thermomechanical treatments. However, the ability to ultrasonically inspect large, thick workpieces of alpha-beta titanium alloys is limited by the attenuation of the ultrasonic inspecting beam due to the microstructural features of the billet. When the attenuation becomes sufficiently great, it is not possible to properly inspect the billet because the strength of the transmitted or reflected ultrasonic signal becomes too small. For this reason, in the critical application requiring good ultrasonic inspectability, the sizes of the billet and of the final article are limited. If it were possible to inspect larger billets ultrasonically, articles could be produced with fewer forging steps, leading to more-economical processing.

There is a need for an improved approach to the conversion of ingots of alpha-beta titanium alloys to billets. The present invention fulfills this need, and further provides related advantages.

BRIEF SUMMARY OF THE INVENTION

The present approach provides a processing procedure for alpha-beta titanium alloy workpieces, which is particularly useful for converting as-cast ingot to billet. The billet is used to fabricate the final article. The present approach achieves the required microstructure in the workpiece, while minimizing the incidence of microstructural features that adversely affect ultrasonic inspectability. The present method is implemented using available furnaces and mechanical working equipment.

A method is provided for processing an alpha-beta titanium alloy workpiece exhibiting a beta-phase field and an alpha-beta phase field in its phase diagram. The workpiece is initially preferably a cast ingot. The method comprises the steps of mechanically working the workpiece at a first alpha-beta phase field temperature in the alpha-beta phase field, thereafter quenching the workpiece from the first alpha-beta phase field temperature, thereafter mechanically working the workpiece at a second alpha-beta phase field temperature in the alpha-beta phase field, wherein the second alpha-beta phase field temperature is lower than the first alpha-beta phase field temperature, and thereafter quenching the workpiece from the second alpha-beta phase field temperature. (All quenching herein is performed by cooling to a lower temperature whereat the higher-temperature processes no longer occur, and preferably to room temperature in normal practice.) The first alpha-beta phase field temperature is desirably high in the alpha-beta phase field, while the second alpha-beta phase field temperature is lower but still within the alpha-beta phase field. In the mechanical working steps, there may be a solution treating of the workpiece at the indicated temperature.

The various temperatures may be constant, or they may be variable such as continuously falling temperatures associated with conventional processing. If the continuously falling temperature ends outside of the indicated phase range, the workpiece may be heated back into the phase range for a final heat treatment.

Desirably, after the step of providing and before the step of mechanically working the workpiece at the first alpha-beta phase field temperature, the method includes mechanically working the workpiece in the beta phase field and in the alpha-beta phase field, and thereafter quenching the workpiece from the beta phase field.

The workpiece may be, and usually is, ultrasonically inspected during or at the conclusion of the processing.

In terms of the microstructures produced, the method preferably comprises the steps of mechanically working the workpiece in the beta phase field and in the alpha-beta phase field, and thereafter quenching the workpiece from the beta phase field to produce a microstructure having coarse alpha-phase platelets and a thin layer of retained beta phase at the alpha-phase platelet interfaces. The method includes mechanically working the workpiece at a first alpha-beta phase field temperature in the alpha-beta phase field to break up and globularize the coarse alpha-phase platelets and to recrystallize (either during working in the alpha-beta phase field or during subsequent solution heat treating in the alpha-beta phase field) the beta-phase matrix to a relatively fine grain size, thereafter quenching the workpiece from the first alpha-beta phase field temperature to produce a microstructure comprising globularized coarse alpha-phase particles and fine alpha-phase platelets, and thereafter mechanically working the workpiece to break up and globularize the fine alpha-phase platelets, thereby producing a microstructure comprising the globularized coarse alpha-phase platelets and globularized fine alpha-phase particles. Desirably, the step of mechanically working the workpiece to break up and globularize the fine alpha-phase platelets includes the steps of mechanically working the workpiece at a second alpha-beta phase field temperature in the alpha-beta phase field, wherein the second alpha-beta phase field temperature is lower than the first alpha-beta phase field temperature, and thereafter quenching the workpiece from the second alpha-beta phase field temperature. Steps described elsewhere herein may be used with this embodiment, to the extent that they are not inconsistent.

Thus, an article comprising an alpha-beta titanium alloy has a microstructure comprising randomized globularized coarse alpha-phase particles and globularized fine alpha-phase particles in transformed beta-phase grains. Such articles are preferably billets. In another form, an article comprises an alpha-beta titanium alloy having a microstructure comprising globularized coarse alpha-phase particles and globularized fine alpha-phase particles in transformed beta-phase grains. The transformed beta-phase grains have a grain size of less than about 0.045 inch, more preferably less than about 0.025 inch, and most preferably 0.005 inch or less. The globularized coarse alpha-phase particles and the globularized fine alpha-phase particles are preferably randomized. This article is also preferably a billet.

The present approach leads to a microstructure of globularized coarse primary alpha-phase particles and globularized fine secondary alpha-phase particles in an alpha-phase matrix transformed from the beta phase. The globularized coarse alpha-phase particles, formed in the mechanical working at the first alpha-beta phase field temperature or in a subsequent heat treatment, inhibit grain growth of the recrystallized beta phase. Consequently, the effective alpha colony size, which is the same as, or smaller than, the recrystallized beta grain size, is small. The small alpha colony size and the absence of alpha platelets in the final article, result in improved ultrasonic inspectability.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
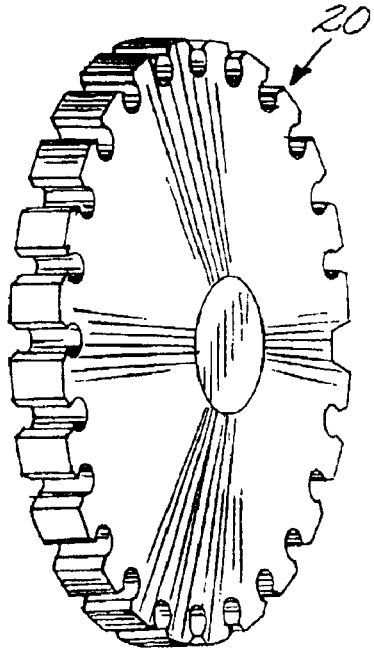
FIG. 1 is a schematic perspective view of an alpha-beta titanium article in the form of a titanium disk precursor.

The present approach may be used to process a wide variety of physical forms of workpieces to produce a wide variety of final articles 20. FIG. 1 illustrates one such article 20 of particular interest, an alpha-beta titanium alloy disk precursor 20. Other types of articles include, for example, blisks, shafts, mounts, and cases. The present approach is not limited to the production of such articles, however.

Figure 3:
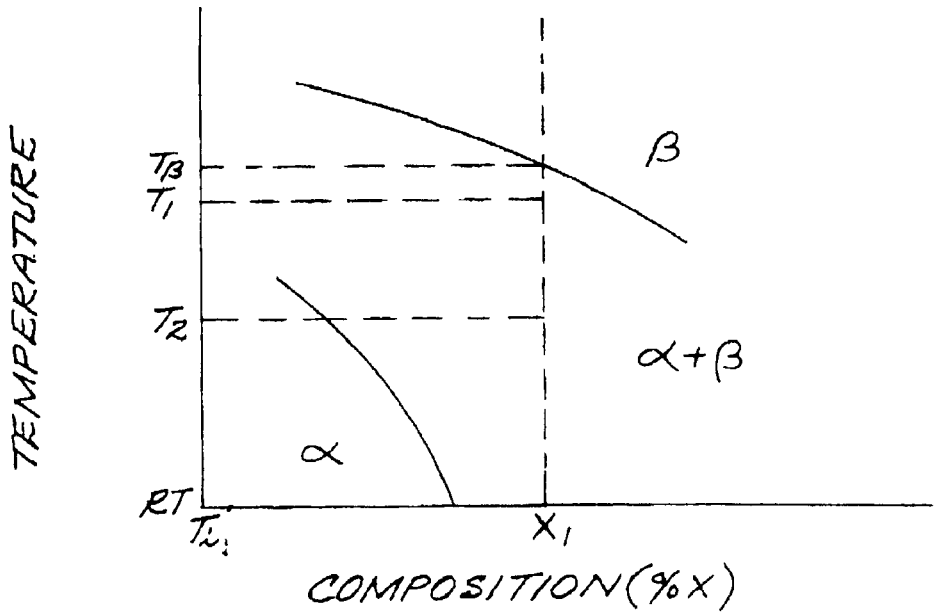
FIG. 3 is a schematic depiction of the relevant portion of the equilibrium phase diagram of the alpha-beta titanium alloy.
Figure 2:
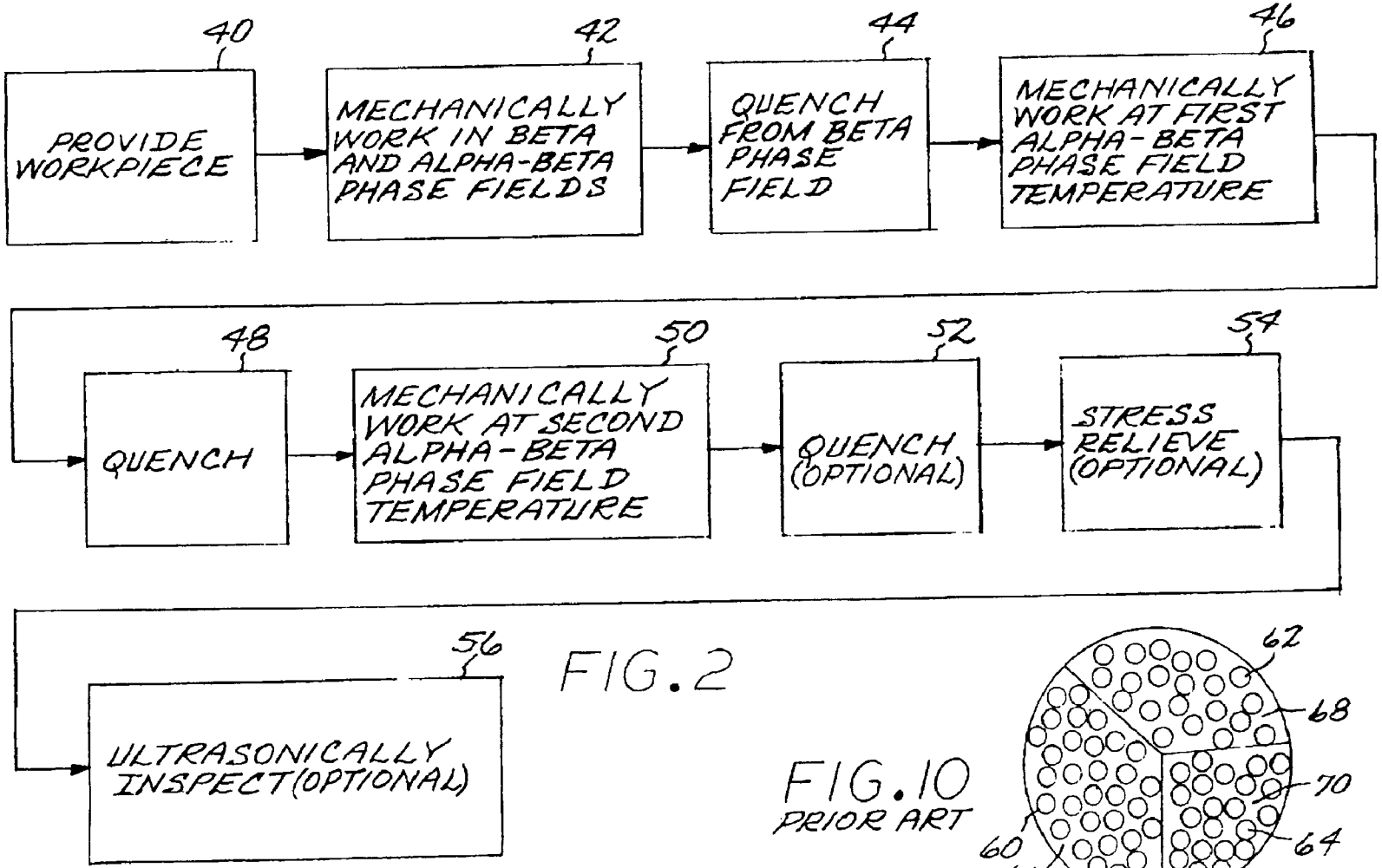
FIG. 2 is a block flow diagram of an approach for preparing an alpha-beta titanium alloy article.

FIG. 2 depicts an approach for processing the alpha-beta titanium alloy and preparing the alpha-beta titanium alloy article 20. A workpiece of an "alpha-beta titanium alloy" exhibiting a beta-phase field, an alpha-beta phase field, and an alpha-phase field in its phase diagram is provided, step 40. FIG. 3 schematically depicts the relevant portions of a temperature-composition equilibrium phase diagram for such an alpha-beta titanium alloy system. (There are many other features to the left and to the right of the indicated region in FIG. 3, but these are not pertinent to the present discussion and are omitted to avoid confusion.) "X" may be any element or combination of elements added to titanium to produce such a phase diagram having the alpha ($\alpha$), beta ($\beta$), and alpha-beta ($\alpha$-$\beta$) phase fields. The line separating the beta phase field from the alpha-beta phase field is termed the beta transus, and the line separating the alpha-beta phase field from the alpha phase field is termed the alpha transus. A specific alloy composition of interest is indicated as composition $X_1$. The beta transus temperature for alloy $X_1$ is $T\beta$, and the alpha transus temperature for alloy $X_1$ is $T\alpha$. However, for most practical alpha-beta titanium alloys $T\alpha$ is below room temperature (RT), and is not illustrated in FIG. 3 Examples of titanium-base alloys that exhibit such a phase diagram and their nominal compositions in weight percent include Ti-6A1-4V (sometimes termed Ti-64), Ti-6A1-2Sn-4Zr-2Mo (sometimes termed Ti-6242), Ti-6A1-2Sn-4Zr-6Mo (sometimes termed Ti-6246), Ti-6A1-2Sn-2Zr-2Mo-2Cr-0.25Si (sometimes termed Ti-6-22-22S), Ti-5.8A1-4Sn-3.5Zr-0.7Nb-0.5Mo-0.35Si (sometimes termed Alloy 834), Ti-5A1-3.5Sn-3.0Zr-1Nb-0.3Si (sometimes termed Alloy 829), Ti-4A1-4Mo-2Sn-0.5Si (sometimes termed Alloy 550), and Ti-5A1-4Mo-4Cr-2Sn-2Zr (sometimes termed Ti-17). The present invention may be utilized with any of these alloys, but is not limited to these alloys and may be used with other operable alpha-beta titanium alloys.

Figure 4:
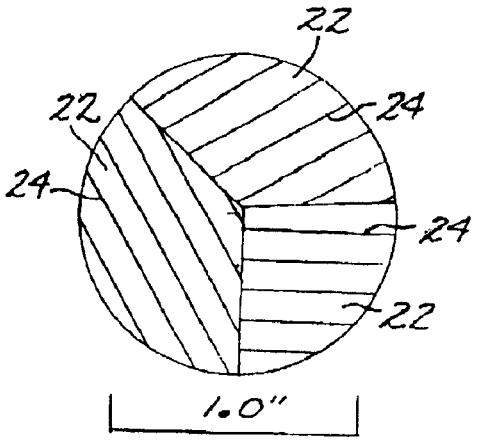
FIGS. 4–9 are schematic microstructures of the workpiece at various stages of the process illustrated in FIG. 2.

The workpiece furnished in step 40 may be of any operable form, but it is preferably an as-cast ingot of the alpha-beta titanium alloy. The microstructure of such an as-cast ingot is illustrated schematically in FIG. 4, together with a representative scale indication. After cooling to room temperature, the as-cast ingot has coarse grains corresponding to the prior beta grains, with portions of three prior beta grains being shown. The as-cast grain size is typically on the order of an inch or more. Within the grains are coarse alpha-phase platelets 22 with a thin layer of retained beta phase 24 at the platelet interfaces. (Terms such as coarse and fine, thick and thin, and the like are used herein in a comparative sense, not with any specific absolute size required.)

Cast ingot material differs qualitatively and quantitatively from other forms in which the workpiece may be furnished. A cast ingot, in addition to exhibiting very coarse grains, typically is compositionally macrosegregated from center to side, and from top to bottom. As a result, the cast ingot cannot be readily heat treated by conventional procedures because of the wide variations in composition throughout the cast ingot. The present approach may be used with cast ingot or other forms of starting workpiece material, but it is most advantageously used with cast ingot starting material because other heat treatment and thermomechanical processing techniques cannot be used with the cast ingot.

The workpiece is thereafter mechanically worked in the beta phase field and in the alpha-beta phase field, step 42. That is, the workpiece is heated to a temperature greater than $T\beta$ and mechanically worked, as by forging, upsetting, rolling, or the like. In a typical case, the workpiece is worked at a temperature in the beta phase field, thereafter brought to a temperature in the alpha-beta phase field and worked. This working in the alpha-beta phase field supplies the mechanical working that leads to recrystallization when the workpiece is later heated above $T\beta$. Alternatively, all of the working may be in the alpha-beta phase field. The amount of work is typically about 20 to 50 percent. The workpiece is thereafter quenched, step 44, from the beta phase field (after first heating from the alpha-beta phase field if the workpiece has cooled into that phase field) and to a low temperature that is in the alpha-beta phase field (i.e., between Tα and Tβ). (All quenching herein is performed by cooling to a lower temperature whereat the higher-temperature processes no longer occur, and preferably to room temperature in normal practice.) The quenching 44 is desirably at a local cooling rate of at least about 1–10° F. per minute, but cannot be accomplished substantially faster due to the thick sections, and is typically accomplished by water quenching.

Figure 5:
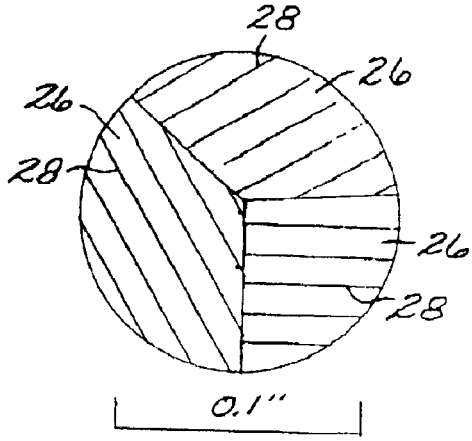

The result is a microstructure such as that shown in FIG. 5, with relatively coarse alpha-phase platelets 26 and a thin later of retained beta phase 28 at the platelet interfaces. The structure of FIG. 5 is similar to that of FIG. 4, except that the scale is reduced by roughly a factor of 10. That is, the microstructural features and grain size are much smaller than those shown in FIG. 4. The alpha-phase platelets 26 may still be described as coarse in respect to their final desired size, however.

The microstructure of FIG. 5 is the starting point for the remainder of the processing. If that microstructure is achieved in other ways, steps 42 and 44 may be omitted.

The workpiece is thereafter mechanically worked, step 46, at a first alpha-beta phase field temperature T1 (see FIG. 3) in the alpha-beta phase field. That is, the workpiece is heated to the temperature T1 in the alpha-beta phase field and mechanically worked, as by forging, upsetting, rolling, or the like. The temperature T1 is desirably near to Tβ, and is preferably such that there is at least about 30 percent by volume of alpha phase present in the equilibrium phase diagram of FIG. 3. The amount of work is typically about 50 percent. Step 46 may include maintaining the workpiece for extended times at temperature T1 to solution treat the workpiece, either before or after the mechanical working. Such extended solution treating at Ti may be for a time of from about 1 to about 16 hours.

Figure 6:
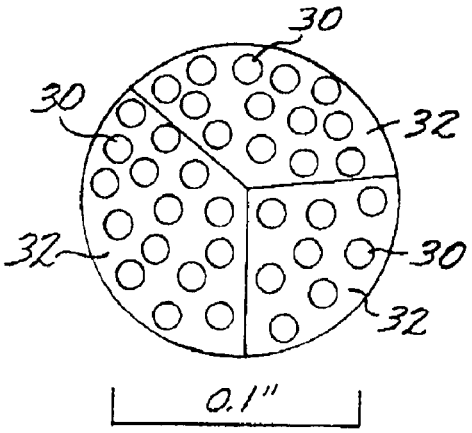
Figure 7:
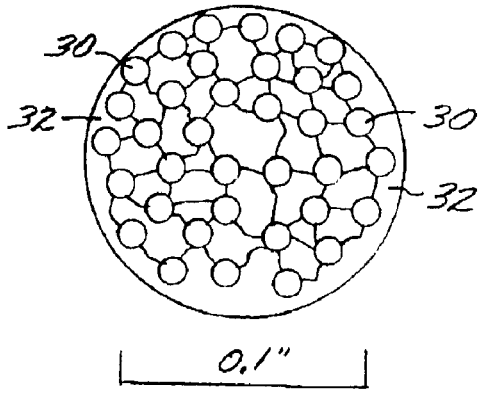

The microstructural results of the mechanical working 46 (with or without the optional further solution treating) are illustrated in FIGS. 6 and 7. The mechanical working 46 at temperature T1 causes the alpha-phase platelets 26 of FIG. 5 to break up and globularize, forming a low volume fraction of generally equiaxed, coarse alpha-phase particles 30 in a coarse-grained beta matrix 32, as shown in FIG. 6. With increasing time at temperature T1, or during subsequent annealing at temperature T1, the beta grains 32 recrystallize to form fine beta grains delimited by the spacings between the coarse alpha-phase particles 30, as shown in FIG. 7. The optional extended solution treating at T1 causes the structure to more closely approach an equilibrium state, thereby slowing the growth of the globularized coarse alpha-phase particles 30 on subsequent cooling.

Figure 8:
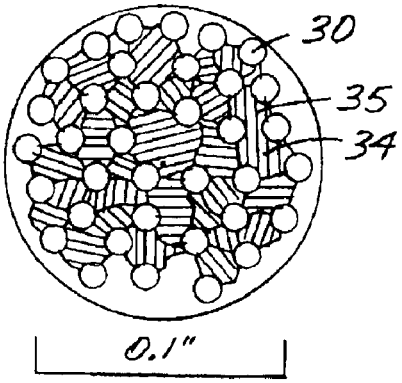

The workpiece is thereafter quenched, step 48, from T1 to a temperature that is in the alpha-beta phase field (preferably to room temperature). The quenching 48 is desirably at a local cooling rate of at least about 5–15° F. per minute, and is typically accomplished by water quenching. The microstructure resulting from the quenching 48 is illustrated in FIG. 8. The coarse alpha-phase particles 30 are present in a transformed beta-phase matrix comprising fine alpha-phase platelets 34, in a transformed beta phase 35. The fine grain size of the matrix, formed step 46 and shown in FIG. 7, is retained.

During the quenching step 48, the coarse alpha-phase particles 30 tend to grow, in a process known as epitaxial re-growth, because the cooling rate in the center of large round billets is relatively slow. The epitaxial re-growth may be minimized by extending the solution time up to 16 hours, which results in essentially equilibrium concentrations of alloying elements in the alpha and beta phases. The driving force for epitaxial re-growth is thereby substantially reduced, with the result that a larger volume fraction of fine alpha plates 34 form.

Figure 9:
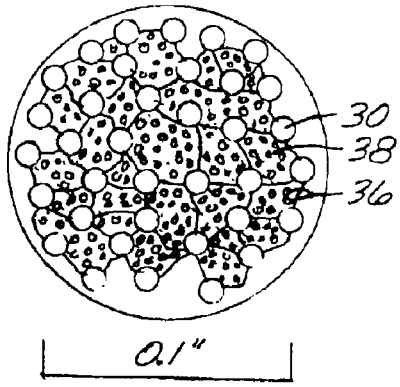

The workpiece is thereafter further mechanically worked to break up and globularize the fine alpha-phase platelets 34. The microstructural result is illustrated in FIG. 9, wherein the microstructure comprises a bimodal distribution of the globularized coarse alpha-phase particles 30 and globularized fine alpha-phase particles 36, both in a fine-grained transformed beta phase matrix 38.

The working is preferably performed by mechanically working the workpiece at a second alpha-beta phase field temperature T2 in the alpha-beta phase field, step 50, wherein the second alpha-beta phase field temperature T2 is lower than the first alpha-beta phase field temperature T1. That is, the workpiece is heated to a second alpha-beta phase field temperature T2 within the alpha-beta phase field but lower than T1 and mechanically worked, as by forging, upsetting, rolling, or the like. The amount of work is typically about 50 percent. Step 50 may include maintaining the workpiece for extended times at temperature T2 to solution treat the workpiece, either before or after the mechanical working. Such extended solution treating at T2 may be for a time of from about 1 to about 16 hours.

In a variation, the second alpha-beta phase field temperature T2 continuously falls in the alpha-beta phase field. This variation includes an additional step, after step 50, of heating the workpiece to a third alpha-beta phase field temperature within the alpha-beta phase field to accomplish solutionizing. The third alpha-beta phase field temperature is within the alpha-beta phase field for the composition of the workpiece, preferably is at or above the second alpha-beta phase field temperature T2 but below Tβ, and is preferably at about the first alpha-beta phase field temperature T1.

In either approach, the workpiece is thereafter optionally quenched, step 52, from the second alpha-beta phase field temperature T2 (or the third alpha-beta phase field temperature) to a lower temperature that is typically within the alpha-beta phase field and is about preferably room temperature. The quenching 52 is desirably at a local cooling rate of at least about 10–20° F. per minute, and is typically accomplished by water quenching. The quenching 52 results in the retention of the structure of FIG. 9, except for the cooling transformation in the transformed beta-phase grains 38.

Optionally, the workpiece may be stress relieved, step 54, after the quenching step 52. The stress relief is typically accomplished at a temperature of about 1100–1400° F. and for 1–4 hours.

The workpiece may be, and preferably is, ultrasonically inspected at one or more points of the processing. FIG. 2 illustrates a final inspection as step 56, but there may additionally be inspections after steps 44, or 48, when the workpiece is at room temperature. The inspections could be performed at elevated temperature as well, but such inspections are more complicated to perform. The inspection 54 is typically only performed if the workpiece is first stress relieved. The present approach achieves improved inspectability by achieving small recrystallized beta grain sizes and thence small alpha colony sizes. The lamellar microstructure and relatively large grains present in conventionally processed alpha-beta titanium alloys tend to increase the attenuation and noise associated with the propagation of ultrasonic waves. By globularizing the alpha phase and reducing the recrystallized beta grain size (and thence the alpha colony size), the present approach improves the ultrasonic inspectability of the workpiece and reduces the ultrasonic noise that otherwise interferes with the ultrasonic inspectability.

The present approach is most preferably used to process as-cast ingot workpieces, or ingot-size titanium workpieces produced by other techniques such as powder metallurgy, into billet. The billet is thereafter processed into final articles by forging or the like. The starting ingot is typically at least about 20 inches or more, and more usually about 30 inches, in minimum cross-sectional dimension. The billet resulting from the processing steps 40–54 is also relatively massive in size, and is typically round in cross-sectional shape and least about 5 inches in minimum cross-sectional dimension. In a usual case, the billet is a cylinder with a diameter of at least about 5 inches. In one case of interest, the final inspected billet is a solid cylinder with a cylindrical diameter of from about 8 to about 12 inches.

One of the problems with conventionally produced alpha-beta titanium alloy billet is that it is difficult to inspect ultrasonically. The difficulty arises because the relatively large size and the microstructure of the conventionally produced billet makes it difficult to propagate ultrasonic signals through the billet with sufficient received signal strength to perform the ultrasonic analysis of defects that may be present in the billet. That is, in the present circumstances the absolute sizes of the workpiece and the microstructural features make a significant difference in ultrasonic inspectability.

Figure 10:
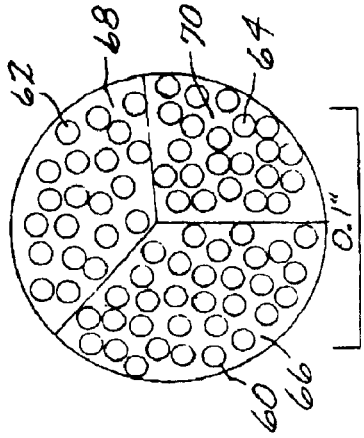
FIG. 10 PRIOR ART
FIG. 10 is a schematic microstructure of a conventionally processed workpiece.

FIG. 10 illustrates a conventional microstructure produced by first working the workpiece (starting from ingot) in the beta phase region and then working the workpiece at a single temperature in the alpha-beta phase field. The conventional microstructure has preferentially oriented coarse alpha-phase particles in a relatively coarse grained transformed beta matrix. FIG. 10 illustrates coarse alpha-phase particles 60, 62, and 64 of three different predominant crystallographic orientations in three respective coarse transformed beta phase grains 66, 68, and 70. These different predominant crystallographic orientations are produced during the initial alpha-phase precipitation in the coarse beta grains. The subsequent working of the billet in conventional processing does not convert these predominant crystallographic orientations into a random structure, but only tends to elongate the grains and thence the coarse alpha-phase particles while retaining the predominant crystallographic orientations. The grain size of the coarse transformed beta phase grains is typically greater than 0.050 inch. These different predominant crystallographic orientations of the phase-phase particles 60, 62 and 64, together with the coarse transformed beta phase grains 66, 68 and 70, constitute a microstructural condition termed "alpha colonies". The alpha-colony microstructure produces a high level of scattering of ultrasonic waves introduced into the workpiece during attempts to inspect the workpiece. The high level of scattering, coupled with the large size of the billet (or other workpiece), inhibits the ability to conduct effective ultrasonic inspection.

The microstructure produced by the present approach, shown in FIG. 9, has the globularized coarse alpha-phase particles 30 and the globularized fine alpha-phase particles 36, in the fine-scale transformed beta-phase grains 38. The size of the globularized coarse alpha-phase particles 30 is preferably less than about 0.005 inch, more preferably from about 0.001 inch to about 0.002 inch. The size of the globularized fine alpha-phase particles 36 is smaller than that of the globularized coarse alpha-phase particles 30, and is preferably less than about 0.002 inch, more preferably from about 0.0005 inch to about 0.001 inch. If the alpha-phase particle sizes are larger, there is an increased likelihood of having alpha colonies present. The grain size of the fine-scale transformed beta-phase grains 38 is less than about 0.045 inch, more preferably less than about 0.025 inch, and most preferably about 0.005 inch or less. If the grain size is larger, there is an increased likelihood of having alpha colonies present.

The crystallographic orientations of both the globularized coarse alpha-phase particles 30 and the globularized fine alpha-phase particles 36 are randomized by the present processing. That is, the regions of alpha-phase particles of different predominant crystallographic orientations and coarse transformed beta-phase grains found in the conventionally processed workpiece of FIG. 10 are not present. The randomized globularized coarse alpha-phase particles 30 and the randomized globularized fine alpha-phase particles 36 of FIG. 9 desirably have fully random crystallographic orientations, but they may have some minor level of non-randomness, particularly for larger-size billets that have not been worked as extensively as smaller-size billets in steps 42, 46, and 50. The finer transformed beta-phase grains 38 produce the fine scale of the globularized fine alpha-phase particles 36, which is not achieved in the conventional microstructure of FIG. 10. The result is greater randomization of the globularized fine alpha-phase particles 36 than could be achieved with the conventional microstructure of FIG. 10.

The randomization of the alpha-phase particles 30 and 36 may be assessed using a process termed "orientation imaging" in the scanning electron microscope (SEM). The microstructure is imaged over an area of several millimeters so that multiple grains and alpha colonies (where present) are visible. The resolution of the image must be such that the various sizes of alpha-phase particles may be seen. The crystallographic orientations of the alpha-phase particles are imaged. False colors are assigned to the orientations, typically with about 10 colors being used in the color spectrum. In a microstructure produced by conventional processing, such as that shown in FIG. 10, large islands of similarly oriented (that is, similarly colored) alpha particles (60, 62, 64) are seen. In a microstructure produced by the present approach, such as that shown in FIG. 9, there is a significantly less-pronounced color grouping in the alpha-phase particles (30, 36). There is desirably little or no indication of an alpha-colony structure, evidenced by little or no color groupings over the extent of, and associated with, the transformed beta grains. If there is a slight indication of an alpha-colony structure, which may be found in the larger billets, even in this case there is a large degree of color noise within the alpha colony. The large degree of color noise indicates improved randomization of the alpha-phase particles within the alpha colony.

The increased randomness of the phases in the microstructure produced by the present approach and exemplified by FIG. 9, as compared with the microstructure produced by the conventional approach and exemplified by FIG. 10, results in reduced, and desirably eliminated, incidence of the alpha colony structure that inhibits ultrasonic inspectability. As a result, the billets produced by the present approach are more readily ultrasonically inspectable than are the billet structures of the conventional processing.

The randomized microstructure and improved inspectability of the billet have important consequences in the processing. The billet of the present approach may be inspected at an earlier stage than the conventional billet, so that defective billet may be detected earlier and removed from the processing or, if possible, repaired. Processing sequences may be altered with reduced steps in the processing, in the present approach as compared with the prior approach. The improved randomization of the microstructure in the present approach also yields important benefits in respect to the production of the final articles from the billet. Specialized redundant-work processing sequences from billet to final article may be used to increase the randomization of the microstructure in the final article produced from non-randomized conventional billet, to enhance ultrasonic inspectability of the final article. These specialized processing sequences add significantly to the cost of the final article. The present approach of producing a randomized, fine-grain microstructure in the billet reduces the need of using the specialized processing during the billet-to-article working, thereby reducing the cost while achieving the improved inspectability of the final article.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method for processing an alpha-beta titanium alloy, comprising the steps of:

providing a workpiece of an alpha-beta titanium alloy exhibiting a beta-phase field and an alpha-beta phase field in its phase diagram; thereafter mechanically working the workpiece at a first alpha-beta phase field temperature in the alpha-beta phase field; thereafter quenching the workpiece from the first alpha-beta phase field temperature; and thereafter mechanically working the workpiece at a second alpha-beta phase field temperature in the alpha-beta phase field, wherein the second alpha-beta phase field temperature is lower than the first alpha-beta phase field temperature.

2. The method of claim 1, wherein the second alpha-beta phase field temperature continuously falls, and wherein the method includes an additional step, after the step of mechanically working the workpiece at the second alpha-beta phase field temperature in the alpha-beta phase field, of heating the workpiece to a third alpha-beta phase field temperature within the alpha-beta phase field.

3. The method of claim 1, including the additional steps, after the step of providing and before the step of mechanically working the workpiece at the first alpha-beta phase field temperature, of mechanically working the workpiece in the beta phase field and in the alpha-beta phase field, and thereafter quenching the workpiece from the beta phase field.

4. The method of claim 3, wherein the second alpha-beta phase field temperature continuously falls, and wherein the method includes an additional step, after the step of mechanically working the workpiece at the second alpha-beta phase field temperature in the alpha-beta phase field, of heating the workpiece to a third alpha-beta phase field temperature within the alpha-beta phase field.

5. The method of claim 1, wherein the step of providing includes the step of providing the workpiece in the form of a cast ingot.

6. The method of claim 1, wherein the step of mechanically working the workpiece at the first alpha-beta phase field temperature in the alpha-beta phase field includes the step of solution treating the workpiece at the first alpha-beta phase field temperature for a time of from about 1 to about 16 hours.

7. The method of claim 1, wherein the step of mechanically working the workpiece at the second alpha-beta phase field temperature in the alpha-beta phase field includes the step of solution treating the workpiece at the second alpha-beta phase field temperature for a time of from about 1 to about 16 hours.

8. The method of claim 1, including an additional step, after the step of providing, of ultrasonically inspecting the workpiece.

9. The method of claim 1 including an additional step, after the step of mechanically working the workpiece at a second alpha-beta phase field temperature in the alpha-beta phase field, of quenching the workpiece from the second alpha-beta phase field temperature.

10. A method for processing an alpha-beta titanium alloy, comprising the steps of:

providing a workpiece of an alpha-beta titanium alloy exhibiting a beta-phase field and an alpha-beta phase field in its phase diagram, wherein the workpiece is provided in the form of a cast ingot; thereafter mechanically working the workpiece in the beta phase field and in the alpha-beta phase field, thereafter quenching the workpiece from the beta phase field; thereafter mechanically working the workpiece at a first alpha-beta phase field temperature in the alpha-beta phase field; thereafter quenching the workpiece from the first alpha-beta phase field temperature; and thereafter mechanically working the workpiece at a second alpha-beta phase field temperature in the alpha-beta phase field, wherein the second alpha-beta phase field temperature is lower than the first alpha-beta phase field temperature.

11. The method of claim 10, wherein the second alpha-beta phase field temperature continuously falls, and wherein the method includes an additional step, after the step of mechanically working the workpiece at the second alpha-beta phase field temperature in the alpha-beta phase field, of heating the workpiece to a third alpha-beta phase field temperature within the alpha-beta phase field.

12. The method of claim 10, wherein the step of mechanically working the workpiece at the first alpha-beta phase field temperature in the alpha-beta phase field includes the step of solution treating the workpiece at the first alpha-beta phase field temperature.

13. The method of claim 10, wherein the step of mechanically working the workpiece at the second alpha-beta phase field temperature in the alpha-beta phase field includes the step of solution treating the workpiece at the second alpha-beta phase field temperature.

14. The method of claim 10, including an additional step, after the step of providing, of ultrasonically inspecting the workpiece.

15. The method of claim 10 including an additional step, after the step of mechanically working the workpiece at a second alpha-beta phase field temperature in the alpha-beta phase field, of quenching the workpiece from the second alpha-beta phase field temperature.

16. A method for processing an alpha-beta titanium alloy, comprising the steps of:

providing a workpiece of an alpha-beta titanium alloy exhibiting a beta-phase field and an alpha-beta phase field in its phase diagram, wherein the workpiece is provided in the form of a cast ingot; thereafter mechanically working the workpiece in the beta phase field and in the alpha-beta phase field, thereafter quenching the workpiece from the beta phase field to produce a microstructure having coarse alpha-phase platelets in transformed beta-phase grains; thereafter mechanically working the workpiece at a first alpha-beta phase field temperature in the alpha-beta phase field to break up and globularize the coarse alpha-phase platelets and to recrystallize the transformed beta-phase grains; thereafter quenching the workpiece from the first alpha-beta phase field temperature to produce a microstructure comprising globularized coarse alpha-phase particles and fine alpha-phase, platelets; and thereafter mechanically working the workpiece to break up and globularize the fine alpha-phase platelets, thereby producing a microstructure comprising the globularized coarse alpha-phase particles and globularized fine alpha-phase particles.

17. The method of claim 16, wherein the step of providing includes the step of providing the workpiece in the form of a cast ingot.

18. The method of claim 16, wherein the step of mechanically working the workpiece to break up and globularize the fine alpha-phase platelets includes the steps of mechanically working the workpiece at a second alpha-beta phase field temperature in the alpha-beta phase field, wherein the second alpha-beta phase field temperature is lower than the first alpha-beta phase field temperature, and thereafter quenching the workpiece from the second alpha-beta phase field temperature.

19. The method of claim 16, including an additional step, after the step of providing, of ultrasonically inspecting the workpiece.

* * * * *

UNITED STATES PATENT AND TRADEMARK OFFICE

CERTIFICATE OF CORRECTION

PATENT NO. : 6,918,974 B2
DATED : July 19, 2005
INVENTOR(S) : Woodfield, Andrew Philip It is certified that error appears in the above-identified patent and that said Letters Patent is hereby corrected as shown below:

Column 12,
Line 2, “alpha-phase, platelets” should be -- alpha-phase platelets --.

Signed and Sealed this

Thirty-first Day of January, 2006

JON W. DUDAS
*Director of the United States Patent and Trademark Office*